US006896327B1

(12) United States Patent
Barile, Sr.

(10) Patent No.: US 6,896,327 B1
(45) Date of Patent: May 24, 2005

(54) FLEXIBLE BACK MECHANISM FOR STACKABLE CHAIRS

(75) Inventor: Peter Barile, Sr., Morristown, TN (US)

(73) Assignee: Daniel Paul Chairs, LLC, Morristown, TN (US)

( * ) Notice: Subject to any disclaimer, the term of this patent is extended or adjusted under 35 U.S.C. 154(b) by 0 days.

(21) Appl. No.: 10/812,481

(22) Filed: Mar. 30, 2004

(51) Int. Cl.[7] ..... A47C 7/44
(52) U.S. Cl. ..... 297/297; 297/285; 297/299; 297/301.5
(58) Field of Search ..... 297/285, 294–299, 297/301.1, 301.5

(56) References Cited

U.S. PATENT DOCUMENTS 5,039,163 A 8/1991 Tolleson
5,902,012 A * 5/1999 Han ..... 297/285
5,904,397 A * 5/1999 Fismen ..... 297/291
6,406,096 B1 * 6/2002 Barile, Sr. ..... 297/301.3
6,471,293 B2 10/2002 Ware et al.

* cited by examiner

*Primary Examiner*—Peter R. Brown
(74) *Attorney, Agent, or Firm*—Pitts & Brittian, P.C.

(57) ABSTRACT

A stackable chair includes a seat assembly and flexible back support having a seat spring system attached therebetween. The seat assembly includes seat sides having spaced apart rear portions. The back support includes lower ends curved forwardly and disposed in registry with and separated by right and left gaps from respective seat side rear portions. Right and left spring members are disposed inwardly adjacent to bridge each gap. Each spring member includes forward ends connected to respective right and left front support members extended inbound from respective seat sides, and includes rear ends connected to opposed ends of a frame rear cross-member. The spring members allow limited reclining movement of the back frame. A limit to excessive forward movement of the back support is provided by pairs of fixation plates positioned in aligned and abutting relationship on upper surfaces of each respective forward and rear ends of each spring member.

25 Claims, 6 Drawing Sheets

FLEXIBLE BACK MECHANISM FOR STACKABLE CHAIRS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF INVENTION

1. Field of Invention

This invention relates generally to the field of movable and stackable seating. More particularly, this invention relates to chairs having a self-adjustable back support while retaining a stackable function.

2. Description of Related Art

Prior chairs having a flexible backrest frame have provided frame members with spring members connected internal of seat tube members for control of movement of the backrest frame of the chair. A typical flexible backrest is illustrated in U.S. Pat. No. 5,039,163, issued to Tolleson, which discloses a chair including depending leg members and a hollow support frame having members with open ends terminating beneath the seat assembly of the chair. The chair includes a pair of hollow backrest frame members having open frame ends extending beneath the seat assembly for alignment with respective open ends of the support frame members. Each open end of the respective frame members includes at least one flexible spring member inserted therein. Prior configurations of spring members allow insertion of opposed spring member ends into opposed and aligned open frame ends, with each spring member being aligned with the frame ends and extended to fill any gap between the respective back frame members and support frame members. Therefore, replacement of the spring member required full disassembly of the chair frame and removal of each inserted spring member end. In order to prevent each spring element from excessive flexing during reclining movements of the chair backrest, the spring member ends have been typically enclosed by pairs of U-shaped brackets of metal that limit the range of angular movement of each enclosed spring member, thereby limiting the reclining movements of the chair backrest. Additional pairs of spring members and U-shaped brackets have been required to be added for rigorous use. The additional pairs of spring members are typically position parallel to each first set of spring members with associated enclosure by U-shaped brackets of greater width or depth, thereby requiring an increased width or depth of the support frame members to accommodate the additional spring members and brackets.

Another example of a chair having a flexible backrest frame is illustrated in U.S. Pat. No. 6,471,293, issued to Ware et al., which discloses a chair frame including respective pairs of seat support leg members having a front spring reinforcement bar interconnected therebetween, and including a back support frame having lower ends with a rear spring reinforcement bar interconnected therebetween. Movements of the back support frame relative to the seat support leg members are regulated by a pair of spring members connected to span between front and rear spring reinforcement bars. Limits to movements of the spring members and back support member are provided by a seat cushion having a two-piece, split platform member with a front portion and rear portion moved relative to each other in response to flexing of spring members. A plurality of bolt brackets affix the spring members opposed ends to each front and rear spring reinforcement bar and to front and rear split platform members of the seat cushion. Repetitive rearward and forward movement of the back support frame flexes each spring member and moves the seat split platform members relative to each other, thereby repetitively flexing the seat cushion.

There is a need for a stackable flexible chair back that provides a spring member assembly attached between a back frame and a seat assembly having a seat cushion thereon, and configured to limit the back frame rearward movement and forward movement while minimizing contact between the spring member assembly and the seat cushion thereby reducing fatigue of the fabric covering the seat cushion. There is a need for a stackable chair having a flexible back frame connected to a seat assembly by a spring mechanism having a minimal number of parts that are readily replaceable to extend the useful life of the stackable chair.

BRIEF SUMMARY OF INVENTION

According to one embodiment of the present invention, a flexible back mechanism for a stackable chair is provided. The flexible back mechanism includes a seat spring system designed to allow reclining movement of a back frame while denying excessive forward movement of a back support relative to a seat assembly. The seat assembly includes right and left seat sides having spaced apart rear portions. Right and left pairs of front and rear leg members are attached outboard of respective right and left seat sides, with each pair of leg members extended in spaced apart orientation to allow stacking with like-configured chair frames.

The back support includes frame lower ends curved forwardly and positioned in registry with and spaced apart by a gap separation from the rear portions of the seat assembly. A back support rear member is attached inwardly of the frame lower ends. Right and left spring members are positioned inwardly adjacent of each frame lower end, with the rear end of each spring member connected to the back support rear member. Each spring member is extended a sufficient length to position a front end forward of each gap separation for connection inwardly adjacent of respective right and left seat sides. Each spring member front end is affixed to respective right and left front support members extended laterally inwardly from and joined to respective rear portions of the seat assembly.

A right and left pair of fixation plates are attached in abutting and aligned relationship in a covering engagement on each front and rear ends of respective spring members in order to securely affix each spring member end during repetitive reclining movements. The pairs of fixation plates in abutting relationship will negate excessive forward pivoting of the back support relative to the seat assembly. During reclining movement of the back support, the rear support member and attached spring member rear ends are pivotably flexed downwardly to a flexed position. Each spring member is capable of repetitive flexing and includes an inherent bias to rebound to a non-flexed position, thereby returning the back support to a substantially upright position when not reclined by a seat occupant.

BRIEF DESCRIPTION OF SEVERAL VIEWS OF THE DRAWINGS

The above mentioned features of the invention will become more clearly understood from the following detailed description of the invention contained herein, read together with the drawings in which.

DETAILED DESCRIPTION OF THE INVENTION

Figure 1:
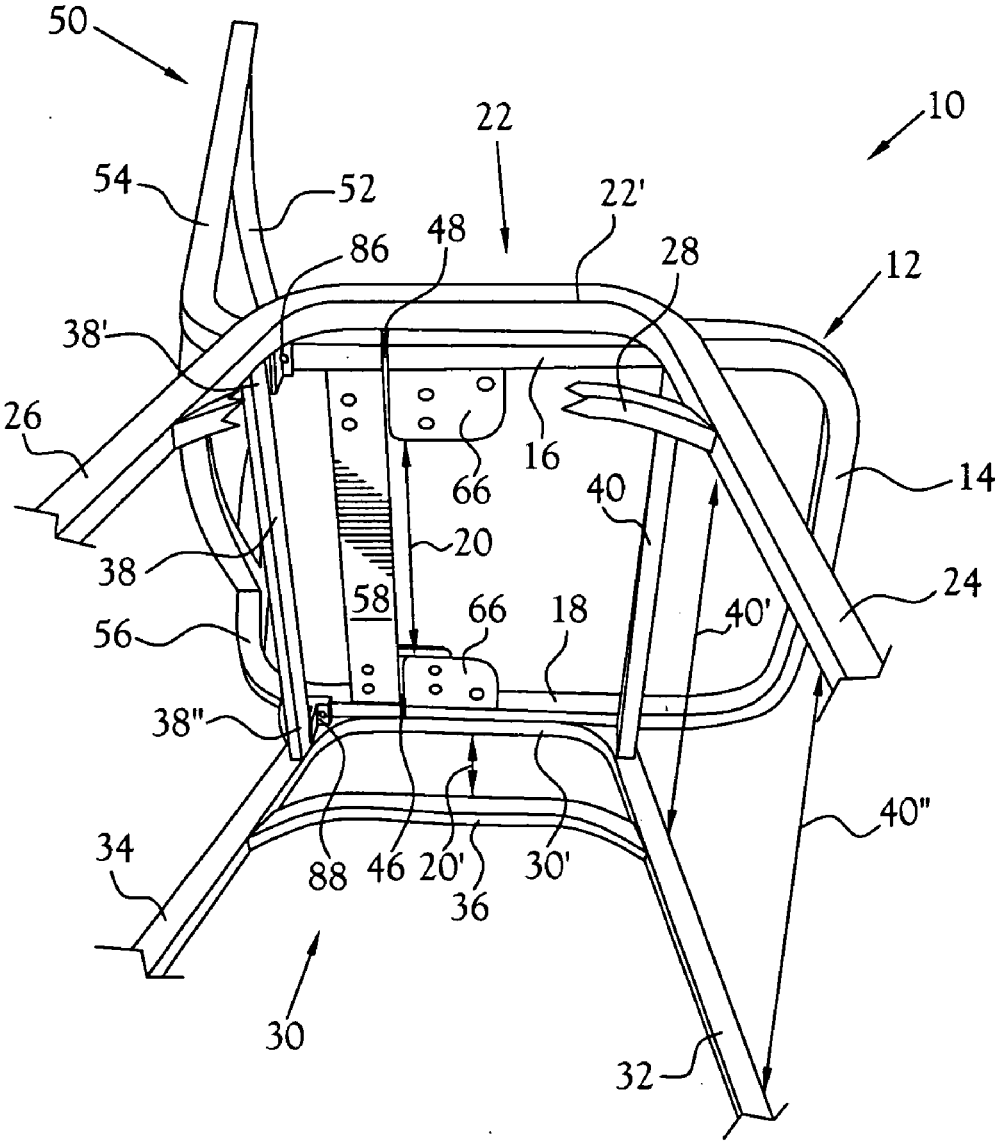
FIG. 1 is a bottom perspective view of one embodiment of a chair illustrating the underside elements of a flexible back chair having a seat spring system in accordance with the present invention.
Figure 2:
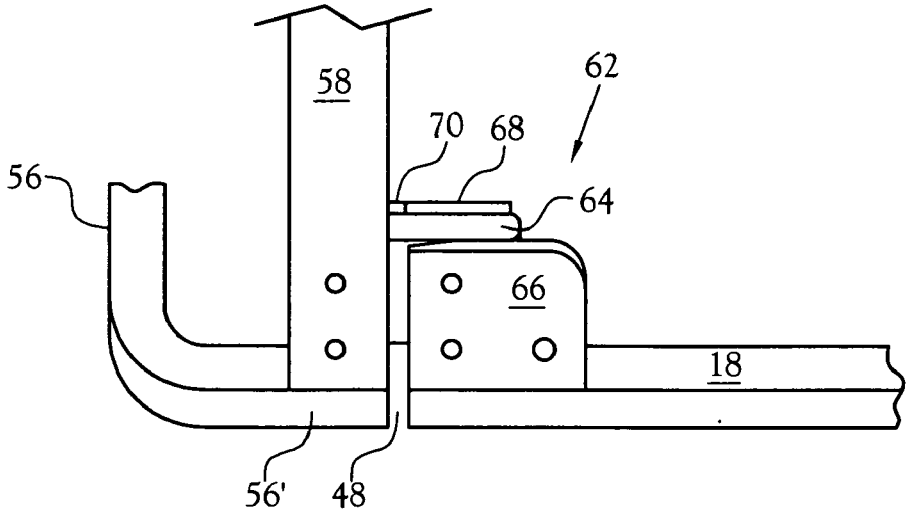
FIG. 2 is a bottom perspective view of FIG. 1, illustrating one unit of the seat spring system of the chair of FIG. 1.
Figure 3:
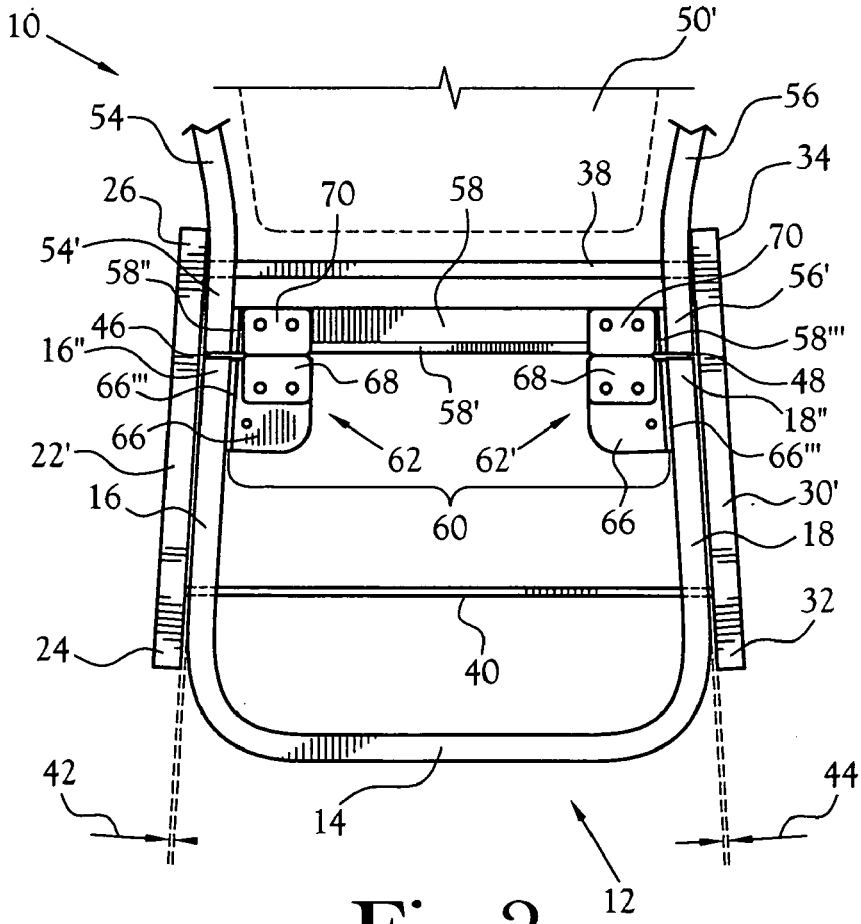
FIG. 3 is a top view of the chair having a seat spring system inwardly projecting from each seat frame member and extending laterally inwardly of a lower portion of a back support frame.

A flexible back mechanism for stackable chairs is disclosed incorporating various features of the present invention for a stackable chair 10 as illustrated in FIGS. 1–7B. The stackable chair 10 of the present invention is designed to provide a seat assembly 12 having a partially reclining back support frame 50 attached to rear portions of the seat assembly 12 by a seat spring system 60. As illustrated in FIG. 3, the seat spring system 60 includes right and left seat spring units 62, 62' disposed laterally and inwardly of respective right and left sides of the seat assembly 12, and laterally inwardly of respective right and left sides of lower portions of a back support frame 50 positioned proximal to rear portions of the seat assembly 12. The seat spring system 60 includes unique features discussed hereinbelow for allowing the back support frame 50 to be reclined backwards within a limited range of motion while limiting excessive forward rebound motion of the back support frame 50 relative to seat assembly 12.

For support of a removable seat cushion 90, the seat assembly 12 includes a front seat member 14 joined at opposed ends to a right seat member 16 and a left seat member 18. The right and left seat members 16, 18 extend rearward to right and left rear portions 16", 18" (see FIG. 3), and are disposed in a substantially horizontal plane extending from the front seat member 14. The right and left rear portions 16", 18" are spaced apart in a generally parallel orientation and do not have a rear seat member extended to connect therebetween. The front, right and left seat members 14, 16, 18 can be any cross-sectional shape utilized for chair frames, including but not limited to cylindrical, oval or square in cross-section. The seat assembly 12 is connected to the back support frame 50 by laterally inwardly positioned right and left spring members 64 of the seat spring system 60 discussed further hereinbelow. The unique configuration of the seat spring system 60 negates a need for a front spring reinforcement cross-support extended between seat members 16, 18, therefore a void space 20 exists between right and left spring units 62, 62'.

The seat assembly 12 is supported at a typical seating height above a supporting surface by a pair of right and left leg member units 22, 30 utilizing right front 24 and rear 26 legs, and left front 32 and rear 34 legs extending downwardly at respective forward and rearward angles. Each leg member unit 22, 30 includes an upper leg member support 22', 30' that is disposed in a substantially horizontal orientation parallel with, and joined outboard to the respective outer surfaces of the right and left seat members 16, 18. The front legs 24, 32 are offset laterally from the rear legs 26, 34 by an outwardly displacement 42, 44 of about one-eighth inch to about one-quarter inch (see FIG. 3), to improve the stability of the stackable chair 12.

The outboard positioning of the right and left leg member units 22, 30 facilitate generally vertical stacking of the chair 10 with like-configured chairs having similarly positioned leg member units disposed outboard of each seat assembly 12. In order to improve stability of the leg member units 22, 30, the front right and left legs 24, 32 can have an upper leg cross member 40 extended between the front legs 24, 32, and positioned below the front portions of respective right and left seat members 16, 18. The front legs 24, 32 can be angled laterally and outwardly to provide a lower leg width separation 40" greater than an upper leg width separation 40' to improve stability of the chair 10 (see FIG. 1). The rear legs 26, 34 have an upper rear cross-member 38 extended between upper portions of the rear legs 26, 34, thereby increasing rigidity of the rear leg members and also providing a stop mechanism for control of backwards pivoting of the back support frame 50 (discussed further hereinbelow).

Additional structural rigidity for the leg member units 22, 30 is provided by a right lateral brace 28, and a left lateral brace 36, with each brace being extended between respective front and rear legs (see FIG. 1). The right lateral brace 28 and left lateral brace 36 are each positioned a spaced apart distance 20' below respective upper leg members 22', 30' (see FIG. 1). Upon stacking of like-configured chairs 10, the lower surface of each lateral brace 28, 36 will contact against the upper surface of the upper leg members of a like-configured seat assembly 12 having similar leg member units 22, 30 attached thereto. Therefore, the spaced apart distance 20' of the lateral braces below respective upper leg members 22', 30' of each chair will maintain the lower portions of the seat assembly 12 spaced apart from the upper surface of a seat cushion 90 of a like-configured chair during stacking of chairs 10, thereby minimizing wear on each seat cushion 90 when stacked. Further, if the lateral braces 28, 36 are attached sufficiently spaced below respective upper leg members 22', 30', the spaced apart distance 20' will allow the respective legs to be aligned but remain spaced apart from each other during stacking, thereby minimizing scraping and abrasion on the legs surfaces during storage and movement of stacked chairs.

A back support frame 50 is positioned to extend generally upright from the rear portions 16", 18" of the right and left seat members 16, 18. The back support frame 50 includes an upper portion 52 joined at opposed ends to right and left frame sides 54, 56 which are spaced apart by a sufficient width to accept a back support cushion 50' detachably connectable thereon (see FIG. 3). Each frame side 54, 56 extends downwardly and is bent forwardly to form respective frame lower ends 54', 56' that extend forwardly to a generally horizontal orientation in aligned registry with and spaced apart from the seat member rear portions 16", 18". Respective right and left frame lower ends 54', 56' are separated by gaps 46, 48 of about one eighth inch to about one quarter inch, from the respective seat member rear portions 16", 18" (see FIGS. 1–3). A back frame support cross-member 58 is attached between the back frame lower ends 54', 56' to increase rigidity of the back support frame 50 and to support each spring member 64 attached thereto. The cross-member 58 includes right and left end flanges 58", 58'" joined by bonding and/or connectors to interior faced surfaces of frame lower ends 54', 56'.

As illustrated in FIGS. 1–3, the stackable chair 10 includes a seat spring system 60 for connecting the lower ends of the back support frame 50 to the rear portions of the seat assembly 12. The seat spring system 60 includes right and left spring units 62, 62' sized and secured to extend between the back support frame 50 and the seat assembly 12 in a configuration allowing the back support frame 50 to be reclined backwards in a limited range of motion while limiting excessive forward motion of the back support frame 50 relative to seat assembly 12. The spring units 62, 62' include like-configured pairs of fixation plates 68, 70 positioned in securing engagement over opposed ends of right and left spring members 64, as illustrated for the left side spring unit 62' in FIG. 4.

In order to provide a back support frame 50 that repetitively reclines and rebounds to a generally vertical position relative to the seat assembly 12, the opposed ends of each spring member 64 of spring units 62, 62' are connected to respective support structures of a lower portion of the back support 50 and rear portions of the seat assembly 12. Each spring member 64 includes a substantially planar and elongated body member having an adequate length to extend adjacently and laterally inboard of the respective gaps 46, 48 between the back frame lower ends 54', 56' and respective rear seat portions 16", 18". One configuration of the spring member 64 includes a length in a range of about three inches to about four inches, having a forward portion 64' and a rear portion 64" (see FIG. 4). The spring member 64 includes a width of about two inches, plus or minus an inch, and a depth of about one fourth of an inch. The overall depth of each spring unit 62, 62' can be readily doubled by stacking and securing opposed ends of stacked spring members 64 (not shown) to provide greater rigidity for the right and left spring units 62, 62' and providing a back support frame 50 less inclined to move rearward 82' (see FIG. 6). A pivot point 76 for each spring member is preferably centered laterally inwardly of a mid-point of respective right and left gaps 46, 48, in order to allow the spring member rear portion 64" to flex downwardly upon reclining movement of the back support frame 50. The spring member rear portion 64" is extended distal of each gap 46, 48 to detachably connect to a portion of the surface of the frame support cross-member 58 attached between the back frame lower ends 54', 56'.

The spring member material is preferably biased to return to a substantially horizontal, non-flexed position 80 for approximately 100,000 or more repetitions without failure. The resilient material of the spring member 64 is produced by layering fiberglass in sheets to a specified depth, width and length. One embodiment of the spring member 64 includes generally rectangular exterior dimensions, a rectangular cross-section, and generally planar upper and lower surfaces to provide a compact cross sectional outline while maintaining the desired stiffness over the expected life of the stackable chair 10. One skilled in the art will recognize that alternative cross-sectional outlines can be utilized such as an elongated spring member having a flattened oval cross-section, with generally planar upper and lower surfaces. Each spring member rear portion 64" is positioned to rotate downwardly during flexing to a flexed position 82 (see FIG. 6), thereby preventing contact with an underside of seat cushion 90. Maintenance to the spring member 64 can be readily provided by detachment and removal of the seat cushion 90 from connection to the right and left seat members 12, 14, detachment of the spring member 64 and installation of a plurality of stacked spring members 64, and/or installation of a more rigid or less rigid spring member in each spring unit 62, 62'.

In order to secure each spring member front portion 64' relative to the seat assembly 12, two front support members 66 are positioned inwardly of respective right and left rear seat portions 16", 18". The following discussion is directed to the left spring unit 62' and front support member 66 illustrated in FIG. 4, but is also indicative of the right spring unit 62 and front support member 66. Each front flanged support member 66 includes a generally rectangular and horizontally oriented body having a width of about two inches to about two and a half inches inboard of each respective seat member 16, 18. In one embodiment, each front flanged support member 66 includes a rounded forward corner 66' that is disposed inwardly toward a central portion of the seat assembly 12. A beveled rear edge portion 66" is provided and is positioned laterally inwardly of the distal end of respective seat member rear portions 16", 18". A flanged portion 66'" is configured to form an "L" shaped cross-sectional outline when viewed from a front or a rear position. The flanged portion 66"" includes a sufficient width of about a half inch to about one inch in order to provide adequate vertically oriented surface area for secure bonding to each respective inwardly faced surface of the right seat member 16 and the left seat member 18. A plurality of connector holes are provided in the base of each front support member 66 for connection of a flexible cover guard 92 underneath each support member 66 (see FIG. 4). At least one additional connector hole 90' is provided for releasably connecting an underside portion of the seat cushion 90 to each support member 66 (see FIGS. 5–6).

In order to minimize contact of each spring element unit 62, 62' with a lower surface of a mounted seat cushion 90, each front support flanged portion 66'" is fixedly joined below the horizontal plane of the seat assembly 12 to the respective inwardly faced surfaces of the right and left seat members 16, 18. In the mounted position, a downwardly oriented lower surface of the front flanged support member 66 is extended inwardly within the seat assembly interior from a generally flush orientation with a lower surface of the right and left seat members 16, 18. The spring member front portion 64' is attached to the upwardly oriented surface of the front flanged support member 66. An adequate length and width for the front flanged support member 66 is provided to provide ample surface area for rigid attachment thereon of the spring member front portion 64'. The width and depth for each front flanged support member 66 is selected to provide a substantially rigid support member formed of metal or other rigid material.

The seat spring system 60 includes unique features to protect each spring member from excessive flexing and premature failure. Each spring member 64 is overlaid on each front support member 66 with a front fixation plate 68 attached in covering relationship over each spring member front portion 64' in order to rigidly secure the front portion of the spring member 64 relative to the seat members 16, 18, and to distribute stress over the width of the spring member front portion 64' during repetitive flexing of the spring member 64. In the orientations illustrated in FIGS. 5 and 6, upon rearward movement 82' to a flexed position 82, the bottom surface of the spring member 64 is contacted against the beveled edges 58' and 66", thereby minimizing abrasion and wear of the spring member 64 during repetitive bending and rebounding of the back support frame 50. Each spring member front portion 64' is rigidly maintained from lateral movement by utilizing a pair of removable connectors 78 extending through each front fixation plate 68, each spring member front portion 64', and each front support member 66.

Each right and left spring member rear portion 64" is secured to an upwardly faced surface on opposed ends of a rear cross-member 58 by a rear fixation plate 70 positioned in a covering relationship thereon, in order to rigidly secure the rear portion 64" relative to each back support frame member, and to distribute stress over the width of the rear portion 64" during repetitive flexing of each spring member 64. Each spring member rear portion 64" is maintained from lateral slippage under each rear fixation plate 70 by utilizing a pair of removable connectors 78 extending through rear fixation plate 70, spring member rear portion 64" and rear cross-member 58. During rearward movement 82' (see FIG. 6), the bottom surface of the spring member 64 is partially engaged 84 against the beveled forward portion 58' of the rear cross-member 58, and is partially engaged 84' against the beveled rear portion 66" of front flanged support member 66, thereby minimizing wear of the surfaces of the spring member 64 during repetitive reclining and forward movements of the back support frame 50.

An effective forward stop mechanism is provided by each pair of fixation plates 68, 70 being aligned in abutting relationship and separated by a space of about 0.0625 inch, or less, between the rear edge 68' of front fixation plate 68 and the front edge 70' of rear fixation plate 70. When the back support frame 50 is reclined backwards 82', the separation space expands minimally 72' (see FIG. 6). When the back support frame 50 rebounds to a generally upright, non-flexed position 80 (see FIG. 5), due to the inherent bias to a planar orientation of each spring member 64, the limited separation space between adjacent edges 68', 70' of the fixation plates 68, 70 provides an abutting relationship 72 serving as a stop mechanism preventing excessive forward movement of the back support frame 50 relative to the seat assembly 12, thereby protecting each spring member 64 from excessive flexing and premature failure.

Figure 5:
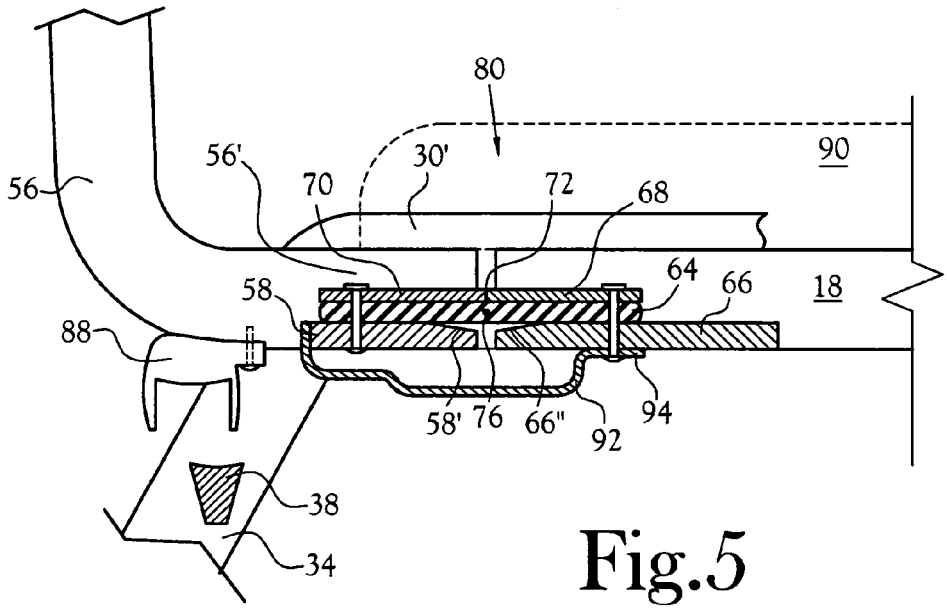
FIG. 5 is a cross-sectional interior side view of the embodiment of FIG. 1, illustrating a non-flexed position for the seat spring system.
Figure 6:
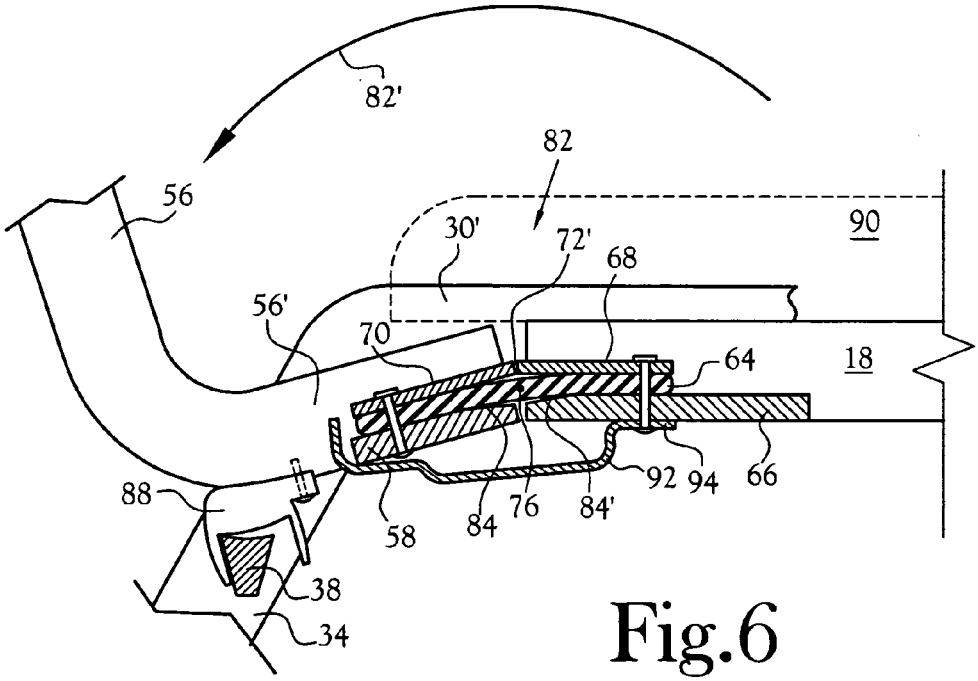
FIG. 6 is a cross-sectional interior side view of the embodiment of FIG. 1, illustrating a flexed position for the seat spring system.

A back frame stop mechanism is incorporated in the seat spring system 60 to prevent excessive backwards or forwards flexing of the back support frame 50. A rear cross-member 38 is extended to join at opposed ends 38', 38" between upper portions of the rear legs 26, 34, as illustrated in FIGS. 1, 5 and 6. An upper surface of the opposed ends of the rear cross-member 38 is positioned about one inch, plus or minus one quarter inch, below the lower surfaces of respective right and left frame lower ends 54', 56'. A right stop guard 86 and a left stop guard 88 are attached to the lower surfaces of respective right and left frame lower ends 54', 56'. The stop guards 86, 88 can be composed of a high density plastic material, a molded polypropylene material, other similar synthetic polymers or a rubber material. Each stop guard 86, 88 is positioned on lower surfaces of respective frame lower ends 54', 56' to allow contact by each stop guard 86, 88 against the upper surface of the rear cross-member 38 when the back frame sides 54, 56 are moved rearward 82' by force applied against the back support frame 50. The stop guards 86, 88 are shaped to extend downwardly about a half-inch from the lower surfaces of the right and left frame lower ends 54', 56', with preferably an inverted "U" shaped configuration to provide an encircling contact by each stop guard with the rear cross-member 38 as the right and left frame lower ends 54', 56' are moved downwardly. Alternate shapes and thicknesses can be selected for the stop guards in order to limit the maximum downwards movement of the respective right and left frame lower ends 54', 56' to about a half-inch of motion. Resulting reclining of the back support frame 50 and downwards flexing of the spring member rear portion 64" is limited to about a half-inch. One skilled in the art will readily recognize that the shape of the stop guards 86, 88, the position of the rear cross-member 38, and the range of extension below the frame lower ends 54', 56' can be altered to provide for greater or lesser reclining movement 82' of the back support frame 50. The stop members 86, 88 prevent excessive backwards reclining of the back support frame 50, thereby limiting the flexing motion of each spring member 64 in order to minimize breakage or fracture of either spring member 64.

Figure 4:
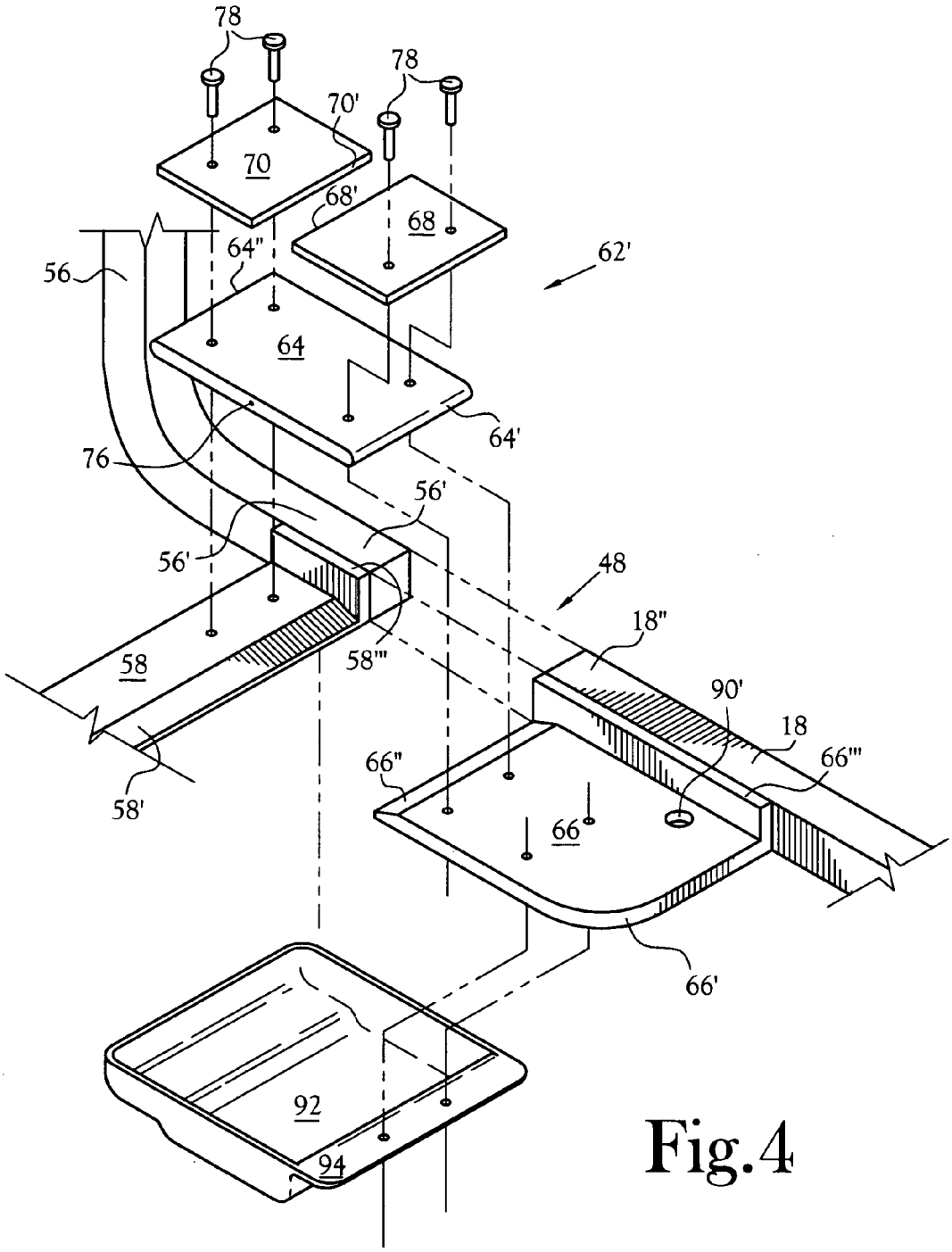
FIG. 4 is an exploded perspective view of one embodiment of the seat spring system positioned to join between a left seat member and a left frame end of the back support frame.

As illustrated in FIGS. 4–6, a flexible cover guard 92 is removably installed underneath and in covering relationship for each respective gap 46, 48 between the rear beveled portion 66" of the front flanged support member 66 and the front beveled 58' of the rear cross-member 58. Each cover guard 92 is composed of pliable plastic material which readily bends during rearward movement 82' of the back support frame 50 and flexing of each spring member 64. Each cover guard 92 is secured by connectors 78 or pop rivets (not shown) extended through a connection portion 94 and attached to respective front support members 66, thereby providing protection from pinching of a seat occupant's fingers when fingers are extended inwardly past right and left upper leg segments 22', 30', and during reclining movement of the back support frame 50 rearwardly 82' (see FIG. 6), and rebounding to a non-flexed position 80 (see FIG. 5). Further protection of a seat occupant's fingers is provided by the detachable cushion 90 being sufficiently sized in width and length to adequately cover the seat assembly 12, thereby denying access from above to the gap separations 46, 48 during reclining movement of the back support frame 50 and rebounding movement to the non-flexed position 80.

Alternative embodiments for the spring element unit 60 include a plurality of spring members 64 stacked and aligned on each other, thereby increasing the rigidity of each spring element unit 62, 62'. Alternative spring members include planar spring members having a plurality of widths, thicknesses, or lengths depending on the design of the stackable chair and the weights of the occupants predicted to be supported by the back support frame 50 during repetitive reclining movements. Each spring member 64 is composed of substantially stiff material, such as one example including layered fiberglass, which is capable of being repetitively flexed along a length dimension without failure. The chemical composition of each spring member 64 can be modified for production of a spring member having greater or lesser flexibility. Each right and left spring member 64 can be independently disconnected and replaced with a like configuration, or an alternative configuration of the spring member without removing the rear cross-member 58 or either of the front flanged support members 66.

An alternative embodiment for the back frame rear cross-member 58 can include back support frame lower ends 54', 56' having attached thereto a pair of inwardly extending rear flanged support members (not shown) shaped similar to, but with a reversed orientation of the front flanged support members 66. The pair of rear flanged support members would replace the rear cross-member 58, and would be attached to extend laterally inwardly from respective right and left frame lower ends 54', 56'. Each rear flanged support member would extend distal of each gap separation 46, 48 and would include a planar base portion for connection thereon of the respective rear portion 64" of each spring member 64. Each rear flanged support member would include a beveled forward edge similar to the beveled forward edge 58' of rear cross-member 58 to minimize abrasive wear of each spring member 64 contacting respective rear flanged support members during reclining movement of the back support frame 50.

The use of inwardly laterally positioned and appropriately sized spring member units 62, 62' for articulated support of the back support frame 50 provides for rapid assembly during manufacture of each chair 10. Each spring member 64 is releasably attachable to the rear cross-member 58 and either front support members 66 for adjustment and/or removal of one or both right and left spring members 64. Each spring member 64 is replaceable with a spring member having similar or alternative properties by removing the readily detachable seat cushion 90, connectors 78 and fixation plates 68, 70.

Figure 7A:
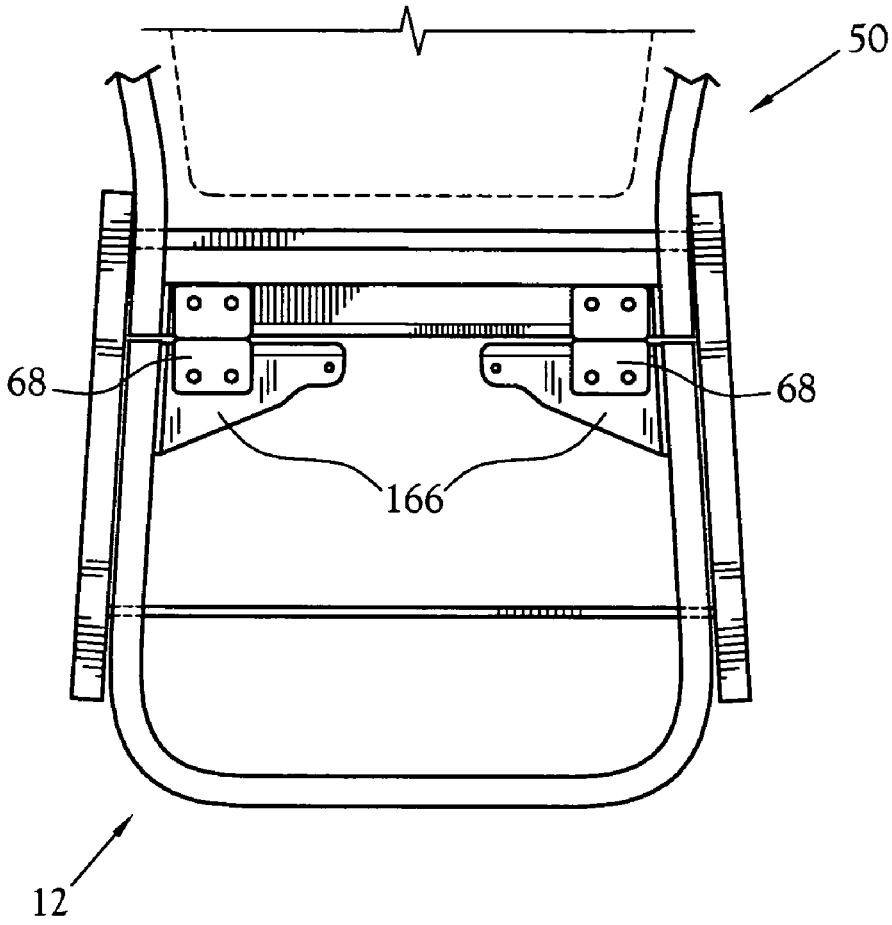
FIG. 7A is a top view of an alternative embodiment for a front flanged support member projecting inwardly from a seat frame member.
Figure 7B:
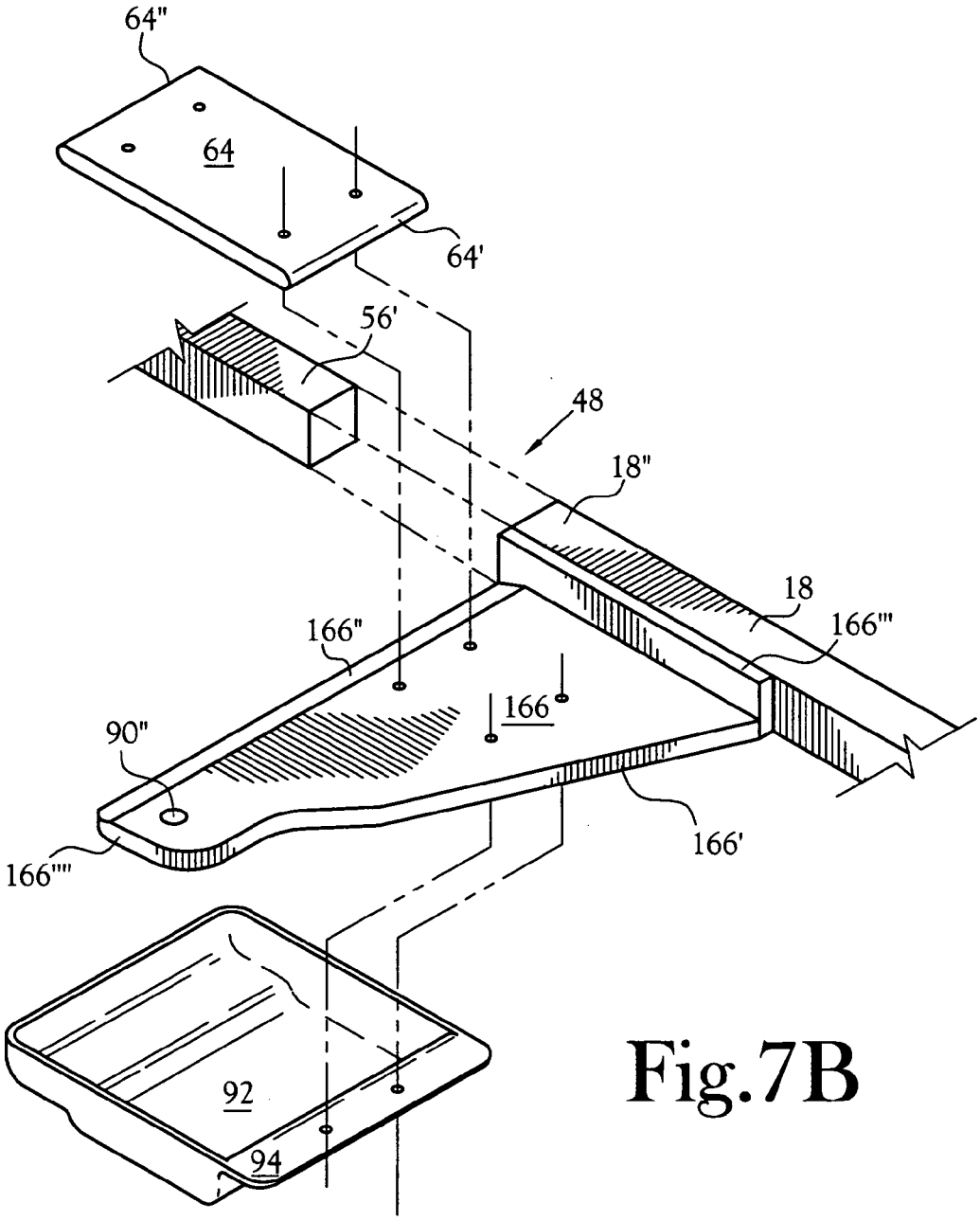
FIG. 7B is an exploded perspective view of the alternative embodiment of FIG. 7A, illustrating a left front flanged support member having a flanged side attached to a left seat member of the seat assembly.

An alternate shape for a front flanged support member 166 is illustrated in FIGS. 7A and 7B. In order to attach a bottom side of the seat cushion 90 (see FIGS. 5 and 6) to a central portion of the seat assembly 12, a front flanged support segment 166 is provided having an elongated base width extending about three and a half inches to about four inches inwardly from each respective seat member 16, 18 to form a curved projection 166"" having an additional connector hole 90" therethrough. Each front flanged support segment 166 includes an arcuate leading edge 166', an upwardly beveled trailing edge 166", and a flanged connecting edge 166'" joined inboard of respective seat members 16, 18. A right front flanged support segment 166 is configured as a mirror-image of the illustrated left front flanged support segment 166 (see FIG. 7A). Spring tension is provided by each front portion 64' of respective spring members 64 being releasably attachable to each front support member 166 as illustrated in FIG. 7B. Each rear portion 64" of respective spring members 64 are releasably attachable to a rear spring support cross-member 58 (see FIGS. 4–6). One skilled in the art will recognize that additional shapes for each front flanged support segment 166 are readily utilized in accordance with the invention disclosed herein. Regardless of the shape of each front flanged support segment 66 or 166, it is important that each front support segment extends partially inwardly between seat members 16, 18, thereby providing a void space 20 between right and left spring units 62, 62' (see FIG. 1), for convenient access to each spring unit 62, 62', and/or access to the bottom of the seat cushion 90 for inspection, disconnection and reconnection for replacement of the seat cushion and periodic maintenance to either spring unit.

While a preferred embodiment is shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A stackable chair, comprising:

a seat assembly including right and left seat members having spaced apart rear portions;

a right and left pair of front and rear leg members supporting said seat assembly and joined outboard of respective seat members to facilitate stacking on a like-configured seat assembly;

a back support including spaced apart right and left side support members extending downwardly to respective right and left lower ends curved forwardly to be positioned in registry with and spaced apart by right and left gap separations from respective seat member rear portions;

a rear support member interposed laterally inwardly from respective right and left back support lower ends, said rear support member forms a back frame cross-member extended to connect between said right and left back support lower ends;

a right and left front support member extended laterally inwardly from respective seat member rear portions, each front support member having side portions joined to respective seat member rear portions forward of respective right and left gap separations, said right and left front support members are spaced apart thereby lacking cross-member support therebetween; and a right and left spring member being separately positioned laterally inwardly of respective right and left gap separations, each spring member having a rear portion disposed laterally inwardly of respective right and left back support lower ends for coupling with said rear support member, each spring member having a front portion disposed laterally inwardly of right and left seat member rear portions for coupling with respective front support members, each spring member being biased to return to a non-flexed position;

whereby said back support is reclined when sufficient force is applied against said back support to pivot said spring member rear portions downwardly to a flexed position, said rear support member and attached back support being returned to a substantially upright position relative to said seat assembly by each spring member being biased to return to the non-flexed position.

2. The stackable chair of claim 1 further comprising a rear leg cross-member having opposed ends joined between respective right and left rear leg members proximally below respective right and left back support lower ends, whereby said back support lower ends having said rear support member interposed inwardly thereof and said spring member rear portions coupled to said rear support member are stopped from further downwards movement by said rear leg cross-member thereby restraining said back support from further reclining movement.

3. The stackable chair of claim 1 further comprising right and left pairs of fixation plates positioned in a covering relationship on upwardly faced front and rear portions of respective spring members, said right and left pairs of fixation plates including:

a front fixation plate connected in said covering relationship on each upwardly faced spring member front portion for fixedly joining each spring member front portion to respective front support members, each front fixation plate having a rear edge positionable proximal of respective right and left gap separations; and a rear fixation plate connected in said covering relationship on each upwardly faced spring member rear portion for fixedly joining each spring member rear portion with respective opposed ends of said frame support cross-member, each rear fixation plate having a front edge positionable in abutting relationship adjacently distal of said rear edge of each front fixation plate and proximal of respective right and left gap separations;

whereby said front fixation plate rear edges periodically contact respective rear fixation plate front edges upon forward movement of said back support when said spring members return to the non-flexed position thereby denying excessive forward movement of said back support past a substantially upright position.

4. The stackable chair of claim 1 wherein said rear support member including said back frame cross-member having opposed flanged ends secured to respective right and left back support lower ends, said back frame cross-member including a leading edge extending between opposed flanged ends, said leading edge having an upwardly beveled configuration positioned for repetitive contact with each spring member rear portion during repetitive reclining movements of said back support, whereby said beveled leading edge minimizes abrasion of respective spring member rear portions during repetitive reclining movements of said back support.

5. The stackable chair of claim 1 wherein said right and left front support member including:

a base portion having a sufficient lateral width extended inwardly from respective right and left seat members for releasably connecting one front portion of either of said right and left spring members;

said side portion of each front support member including a flanged side member extended perpendicular to said base portion and having a side surface of sufficient width to be rigidly joined to respective inboard surfaces of said right and left seat members; and a rearward edge extended inwardly from respective right and left seat members, said rearward edge having an upwardly beveled configuration positioned to be repetitively contacted by respective spring member front portions, whereby said beveled configuration minimizes abrasion of respective spring member front portions during repetitive reclining movements of said back support.

6. The stackable chair of claim 1 wherein said right and left pairs of leg members including a right and left side reinforcement member extended between each front and rear leg member, each respective side reinforcement member is aligned parallel with and spaced apart below respective right and left seat members.

7. The stackable chair of claim 1, further comprising:

a seat cushion removably connected to be supported on said seat assembly, said seat cushion having a sufficient width to extend between said right and left seat members and having a sufficient length to cover said back support lower ends positioned in registry with and spaced apart by said right and left gap separations from respective seat member rear portions, whereby said gap separations are covered by said seat cushion thereby negating access from above said seat cushion during repetitive reclining movements of said back support relative to said seat assembly; and a back support cushion removably connected to be supported by said back support, said back support cushion including a sufficient width to extend between said right and left side support members and having a sufficient length for support of a seated occupant during repetitive reclining movements of said back support relative to said seat assembly.

8. The stackable chair of claim 7, further comprising a right and left cover guard removably positioned underneath each respective gap separation and in covering relationship of each respective gap separation, each cover guard is composed of pliable material readily bendable during repetitive movement of said spring members between the non-flexed position to the flexed position, whereby said cover guards minimize finger intrusion into either gap separation during repetitive reclining movements of said back support relative to said seat assembly.

9. The stackable chair of claim 1 wherein said right and left spring members are substantially planar along a length dimension.

10. A stackable chair, comprising:

a seat assembly including right and left seat members having spaced apart rear portions, said right and left seat members being disposed in a substantially horizontal plane for placement of a removable seat cushion thereon;

a right and left pair of front and rear leg members supporting said seat assembly and joined outboard of respective seat members to facilitate stacking on a like-configured seat assembly;

a back support including spaced apart right and left frame members extending to respective right and left frame lower ends curved forwardly to be positioned in registry with and spaced apart by a gap separation from said rear portions of said right and left seat members;

a rear support cross-member having flanged ends positioned to extend inwardly between respective right and left frame lower ends;

a right and left spring member positioned to extend laterally inwardly of respective right and left gap separations, each spring member having a rear portion disposed laterally inwardly of respective right and left frame lower ends for fixed coupling with respective flanged ends of said rear support cross-member, each spring member having a front portion extended to be disposed laterally inwardly of each rear portion of said right and left seat members, each spring member is biased to a non-flexed position; and a right and left front support member extended laterally inwardly a sufficient width from respective right and left seat members for coupling thereon of said front portion of respective right and left spring members, said right and left front support members are spaced apart and lack cross-member support therebetween;

whereby upon said back support being moved to a reclined position, said right and left spring members are flexed to a flexed position with respective spring member rear portions moved downwardly without either spring member contacting the seat cushion positioned on the seat assembly.

11. The stackable chair of claim 10 further comprising:

right and left pairs of fixation plates positioned in a covering relationship on upwardly faced front and rear portions of respective spring members, said right and left pairs of fixation plates including:

a front fixation plate connected in said covering relationship on each upwardly faced spring member front portion for fixedly joining each spring member front portion to respective front support members, each front plate having a rear edge positionable proximally above respective right and left gap separations; and a rear fixation plate connected in said covering relationship on each upwardly faced spring member rear portion for fixedly joining each spring member rear portion with respective opposed ends of said frame rear support cross-member, each rear fixation plate having a front edge positionable in abutting relationship adjacently distal of said rear edge of each front fixation plate and proximally above respective right and left gap separations;

whereby said front fixation plate rear edges periodically contact respective rear fixation plate front edges upon forward movement of said back support when each spring member returns to the non-flexed position thereby denying excessive forward movement of said back support past the substantially upright position.

12. The stackable chair of claim 11 wherein said right and left front support members including:

a base portion having a sufficient lateral width extended inwardly from respective right and left seat members for releasably connecting one front portion of either of said right and left spring members;

a flanged side member extended perpendicular to said base portion and having a side surface of sufficient width to be rigidly joined to respective inboard surfaces of said right and left seat members; and a rearward edge extended inwardly from respective right and left seat members, said rearward edge having an upwardly beveled configuration positioned to be repetitively contacted by respective lower surfaces of said spring member front portion, whereby said beveled configuration reduces wear of each spring member front portion during repetitive contact against said beveled rearward edge by downwardly movements of each spring member front portion resulting from reclining of said back support.

13. The stackable chair of claim 12 wherein said right and left pairs of leg members including a right and left side reinforcement member extended between each front and rear leg member, each respective side reinforcement member is aligned parallel with and spaced apart below said upper leg segment of each right and left leg member unit.

14. The stackable chair of claim 13 wherein said right and left pair of front and rear leg members including:

a right side lateral brace extended between respective right front and right rear leg members, said right side lateral brace disposed generally parallel below said right upper leg segment; and a left side lateral brace extended between respective left front and left rear leg members, said left side lateral brace disposed generally parallel below said left upper leg segment.

15. The stackable chair of claim 10, further comprising a rear leg cross-member having opposed ends joined between respective right and left rear leg members proximally below respective right and left frame lower ends, whereby said frame lower ends are stopped from further downward movement by said rear leg cross-member thereby restraining said back support from further reclining movement.

16. The stackable chair of claim 10 wherein said right and left spring members having generally planar upper and lower surfaces and are composed of material biased to rebound to said non-flexed position, whereby said back support is returned to a substantially upright position upon removal of induced reclining movement of the back support.

17. The stackable chair of claim 10 wherein said rear support cross-member including a leading edge extending between opposed ends and having an upwardly beveled configuration positioned to be repetitively contacted by respective lower surfaces of each spring member rear portion with resulting reduction in wear of each spring member rear portion during repetitive contact against said bevel by downwardly movements of each spring member rear portions forced by reclining movements of said back support.

18. A stackable chair comprising:

a seat assembly including a front seat member joined to right and left seat members having spaced apart rear portions, said seat assembly disposed in a substantially horizontal plane to receive a seat cushion thereon;

a pair of right and left inverted U-shaped leg members supporting said seat assembly, each pair of leg members having right and left upper leg segments joined outboard of respective right and left seat members;

a back support frame including spaced apart right and left frame members upstanding relative to the pair of seat support frame members, each right and left frame member having a lower end curved forwardly and disposed in registry behind said right and left seat members rear portions, said lower ends of said frame members being positioned in spaced apart alignment across respective right and left gap separations from respective right and left seat members;

a right and left spring member positioned for bridged extension laterally inwardly between said right and left frame member lower ends and said rear portions of said right and left seat members, each spring member having a front end disposed laterally inwardly of respective rear portions of said seat members, and having a rear end disposed laterally inwardly of respective frame member lower ends;

right and left pairs of fixation plates positioned in respective covering relationships on upwardly faced front and rear ends of respective spring members;

a right and left front support member extended laterally inwardly from respective right and left seat members, each front support member is disposed proximally forward of respective right and left gap separations, each front support member having an adequate lateral width for fixed coupling thereon of said front end of respective right and left spring members, said right and left front support members lack cross-member support therebetween;

a frame rear cross-member having opposed ends interposed inwardly between respective right and left frame member lower ends, said opposed ends of said rear cross-member having an upper surface for fixed coupling thereon of said rear end of respective right and left spring members, whereby each right and left spring members are laterally inwardly joined between respective right and left front support members and said upper surface of said frame rear cross-member, thereby each right and left spring member is maintained in bridging relationship laterally inwardly of respective right and left gap separations; and a rear restraint bar connected between respective right and left rear leg members and positioned proximally beneath said frame member lower ends, whereby when said back support frame is reclined with resulting flexing downwardly of said spring member rear portion ends, said frame member lower ends are contacted against said rear restraint bar whereby reclining movement is limited for said back support frame.

19. The stackable chair of claim 18 wherein said right and left spring members having generally planar upper and lower surfaces and having a depth between said upper and lower surfaces being composed of material biased to rebound to a non-flexed position for said upper and lower surfaces whereby said back support frame is returned to a substantially upright position after each reclining movement of said back support frame.

20. The stackable chair of claim 18 further comprising said right and left pairs of fixation plates including:

a front fixation plate connected in said covering relationship on each upwardly faced spring member front portion for fixedly joining each spring member front portion to respective front support members, each front fixation plate having a rear edge positionable proximally above respective right and left gap separations; and a rear fixation plate connected in said covering relationship on each upwardly faced spring member rear portion for fixedly joining each spring member rear portion with respective opposed ends of said frame rear cross-member, each rear fixation plate having a front edge positionable in abutting relationship adjacently distal of said rear edge of each front fixation plate on said upper surface of each spring member positioned adjacent respective right and left gap separations;

whereby said front fixation plate rear edges periodically contact respective paired rear fixation plate front edges upon forward movement of said back support frame when each spring member returns to said non-flexed orientation thereby denying excessive forward movement of said back support frame past a substantially upright position.

21. The stackable chair of claim 20 wherein said right and left front support members including:

a base portion having a sufficient lateral width extended inwardly from respective right and left seat members for releasably connecting thereon of respective front portions of respective right and left spring members;

a flanged side member extended perpendicular to said base portion and having a side surface of sufficient width to be rigidly joined to respective inboard surfaces of said right and left seat members; and a rearward edge extended inwardly from respective right and left seat members, said rearward edge having an upwardly beveled configuration positioned to be repetitively contacted by respective lower surfaces of each spring member front portion with resulting reduction in wear of each spring member front portion during repetitive contact against said beveled rearward edge by downwardly movements of each spring member front portions resulting from reclining movements of said back support frame.

22. The stackable chair of claim 18 wherein said frame rear cross-member including a leading edge extending between opposed ends and having an upwardly beveled configuration positioned to be repetitively contacted by respective lower surfaces of each spring member rear portion with resulting reduction in wear of each spring member rear portion during repetitive contact against said bevel by downwardly movements of each spring member rear portions forced by reclining movements of said back support frame.

23. The stackable chair of claim 18 wherein said right and left pair of front and rear leg members including:

a right side lateral brace extended between respective right front and right rear leg members, said right side lateral brace disposed generally parallel below said right upper leg segment; and a left side lateral brace extended between respective left front and left rear leg members, said left side lateral brace disposed generally parallel below said left upper leg segment.

24. A stackable chair, comprising:

a seat assembly including right and left seat members having spaced apart rear portions;

a right and left pair of front and rear leg members supporting said seat assembly and joined outboard of respective seat members to facilitate stacking on a like-configured seat assembly;

a back support including spaced apart right and left side support members extending downwardly to respective right and left lower ends curved forwardly to be positioned in registry with and spaced apart by right and left gap separations from respective seat member rear portions;

a rear support member interposed laterally inwardly from respective right and left back support lower ends, said rear support member including a back frame cross-member having opposed flanged ends secured to respective right and left back support lower ends, said back frame cross-member including a leading edge extending between opposed flanged ends, said leading edge having an upwardly beveled configuration positioned for repetitive contact with each spring member rear portion during repetitive reclining movements of said back support, whereby said beveled leading edge minimizes abrasion of respective spring member rear portions during repetitive reclining movements of said back support;

a right and left front support member extended laterally inwardly from respective seat member rear portions, each front support member having side portions joined to respective seat member rear portions forward of respective right and left gap separations, said right and left front support members are spaced apart thereby lacking cross-member support connecting therebetween; and a right and left spring member being separately positioned laterally inwardly of respective right and left gap separations, each spring member having a rear portion disposed laterally inwardly of respective right and left back support lower ends for coupling with said rear support member, each spring member having a front portion disposed laterally inwardly of right and left seat member rear portions for coupling with respective right and left front support members, each spring member being biased to return to a non-flexed position;

whereby said back support is reclined when sufficient force is applied against said back support to pivot said spring member rear portions downwardly to a flexed position, said rear support member and attached back support being returned to a substantially upright position relative to said seat assembly by each spring member being biased to return to the non-flexed position.

25. The stackable chair of claim 24 wherein said right and left front support member including:

a base portion having a sufficient lateral width extended inwardly from respective right and left seat members for releasably connecting one front portion of either of said right and left spring members;

said side portions of each front support member including a flanged side member extended perpendicular to said base portion and having a side surface of sufficient width to be rigidly joined to respective inboard surfaces of said right and left seat members; and a rearward edge extended inwardly from respective right and left seat members, said rearward edge having an upwardly beveled configuration positioned to be repetitively contacted by respective spring member front portions, whereby said beveled configuration minimizes abrasion of respective spring member front portions during repetitive reclining movements of said back support.

* * * * *